US005698223A

United States Patent [19]

Mychajlowskij et al.

[11] Patent Number: 5,698,223

[45] Date of Patent: Dec. 16, 1997

[54] TONER PROCESS

[75] Inventors: Walter Mychajlowskij, Georgetown; Guerino G. Sacripante; Raj D. Patel, both of Oakville, all of Canada; Grazyna E. Kmiecik-Lawrynowicz, Fairport, N.Y.

[73] Assignee: Xerox Corporation, Stamford, Conn.

[21] Appl. No.: 829,551

[22] Filed: Mar. 28, 1997

[51] Int. Cl.[6] ..... G03G 9/087

[52] U.S. Cl. ..... 430/137

[58] Field of Search ..... 430/137

[56] References Cited

U.S. PATENT DOCUMENTS

| | | | |
|---|---|---|---|
| 4,797,339 | 1/1989 | Maruyama et al. | 430/109 |
| 4,996,127 | 2/1991 | Hasegawa et al. | 430/109 |
| 5,344,738 | 9/1994 | Kmiecik-Lawrynowicz et al. | 430/137 |
| 5,364,729 | 11/1994 | Kmiecik-Lawrynowicz et al. | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |

*Primary Examiner*—Roland Martin
*Attorney, Agent, or Firm*—E. O. Palazzo

[57] ABSTRACT

A process for the preparation of toner comprising (i) solubilizing an imide based resin in water at pH of from about 10 to about 13 and which solubilizing is accomplished in the presence of nonionic surfactants and anionic surfactants; followed by precipitating the resulting dissolved imide resin into colloidal particles with a size diameter of from about 20 nanometers to about 500 nanometers, and which precipitating is accomplished with a high shearing device operating at a speed of from about 500 to about 2,000 revolutions per minute; acidifying the resulting mixture to a pH of from about 2 to about 4;

(ii) preparing a pigment dispersion in water, which dispersion is comprised of a pigment, an oppositely charged ionic surfactant and optionally charge control agent;

(iii) shearing (i) and (ii), thereby causing a flocculation of the resin, pigment, surfactants, and optional charge control agent;

(iv) heating the resulting flocculent mixture of (iii) with stirring at a temperature of from about 25° C. to about 1° C. below the glass transition temperature (Tg) of the imide resin to effect formation of electrostatically bounded toner sized aggregates, and wherein the imide resin has a Tg of from about 45° C. to about 65° C.;

(v) heating the resulting aggregate suspension of (iv) in the presence of additional anionic surfactant selected in an amount of from about 0.01 to about 5 weight percent based on the weight percent of the total reaction mixture solids, and which heating is at a temperature of from about 10° C. to about 55° C. above the Tg of the imide resin; and optionally cooling, and optionally (vi) separating said toner by washing, and thereafter drying said toner.

21 Claims, No Drawings

TONER PROCESS

BACKGROUND OF THE INVENTION

The present invention is generally directed to toners, and toner processes, and more specifically, to a process which comprises the preparation of imide based toner resin particles, and subsequent aggregation of these resin particles with colorant, especially pigments, and additive toner particles into toner sized aggregates, followed by coalescence or fusion by heating of the resulting aggregates to form integral toner particles. In embodiments, the present invention is directed to a chemical in situ process for generating toners without resorting to conventionally known pulverization and classification methods, thus rendering the process economical, and wherein toner compositions can be obtained with a particle size as herein illustrated by volume average diameter of from about 1 to about 20, and preferably from 2 to about 10 microns, and narrow particle size distribution as conventionally characterized by GSD (geometric standard deviation) of, for example, from about 1.10 to about 1.35, and more specifically, from about 1.15 to about 1.25 as measured on the Coulter Counter. The resulting toners can be selected for known electrophotographic imaging and printing processes. In embodiments, the present invention is directed to an in situ process for the preparation of toners comprised of an imide based resins, such as those disclosed in U.S. Pat. Nos. 5,348,830; 5,409,793; 5,411,829; 5,411,831; 5,413,888; 5,427,882; 5,413,889; 5,427,881; 5,512,401, and 5,552,254, the disclosures of which are totally incorporated herein by reference.

The present invention relates to processes comprising (i) solubilizing an imide based resin in caustic aqueous conditions, such as a pH of from about 10 to about 13, and which solubilizing is in the presence of a nonionic and anionic surfactant, followed by precipitating the dissolved imide resin into a colloidal particle of, for example, from about 20 nanometers to about 500 nanometers by, for example, utilizing a high shearing device operating at, for example, a speed of from about 500 to about 2,000 revolution per minute and acidifying the mixture to a pH of from about 2 to about 4; (ii) adding an aqueous pigment dispersion containing an oppositely charged ionic surfactant, such as a cationic surfactant, and optional charge control additives and other known toner additives; and (iii) aggregating; followed by heating at, for example, from about 10° to about 50° C. above the glass transition temperature of the imide based resin for a duration of from, for example, about 30 minutes to about 6 hours to afford coalesced toner particles. The volume average diameter of the imide colloidal particles is, for example, from about 0.01 micron to about 1.0 micron, and preferably from about 0.05 to about 0.5 microns, and the amount of each ionic surfactant ranges, for example, from about 0.01 percent to about 5 percent by weight of the total amount of the reaction mixture. The mixing of the two oppositely charged surfactants induces flocculation of the imide resin particles, pigment and optional additive particles, which flocculent mixture, on heating with, for example, gentle stirring at a temperature range of, for example, from about 25° C. to about 1° C. below the glass transition temperature (Tg) of the latex resin, enables the formation of electrostatically bound toner sized aggregates, or aggregates comprised of the imide resin, pigment and optional additive particles. The size of the aggregates is primarily dependent on the temperature at which aggregation is accomplished, and for a given latex composition, larger aggregates are obtained at higher temperatures, provided that the temperature is not substantially above the Tg of the resin. Also, the particle size distribution of the aggregates does not appear to be dependent on the aggregation temperature, and is generally narrow as typified by a GSD of less than 1.35, and more specifically, of less than about 1.25. These aggregates, which for example, have a volume average diameter of about 1 to 20 microns, are then subjected to further heating, optionally in the presence of additional anionic surfactant at a temperature above the Tg of the resin, and more specifically, at a temperature ranging from about 10° C. to about 50° C. above the Tg for an effective time period, for example about 2 hours in embodiments, to effect fusion or coalescence of the latex particles within the aggregates affording integral toner particles. The degree of coalescence is dependent, for example, on the temperature and duration of the heating. Suitable temperatures for coalescence range, for example, from about equal to, or slightly above the resin Tg to in excess of about 100° C., depending on the nature of the imide based resin, its composition, and the pigment and optional additives. In general, the coalescence is conducted at a temperature of between about 65° C. to about 110° C., and preferably between about 75° C. to about 105° C. The resulting toner particles retain the size of the precursor aggregates, that is, the volume average particle size of the aggregate is preserved during coalescence wherein electrostatically bound aggregates are converted to integral toner particles as a result of the fusion of the resin particles within the aggregate particles.

In another embodiment thereof, the present invention is directed to an economical chemical process comprised of first solubilizing an imide based resin, such as poly(5-2(2,5-dioximide-tetrahydro)3-methyl-3-cyclohexene-1,2-dicarboxylimide-N-propyleneoxypropylene), in water containing a nonionic surfactant, such as sodium dodecylbenzene sulfonate, for example NEOGEN R® or NEOGEN SC®, and a nonionic surfactant, such as alkyl phenoxy poly(ethyleneoxy)ethanol, for example IGEPAL 897™ or ANTAROX 897™, and utilizing a base, such as potassium hydroxide, to adjust the pH to from about 10 to about 13, or about 10 to about 11, followed by precipitating the resin as a latex by adjusting the pH to acidic conditions using an acid, such as hydrochloric acid, during blending by high shear mixing, followed by adding an aqueous pigment dispersion containing a pigment, such as HELIOGEN BLUE™ or HOSTAPERM PINK™, and a cationic surfactant, such as benzalkonium chloride (SANIZOL B-50™). The mixing of the two dispersions with two oppositely charged surfactants induces flocculation of the imide resin latex, pigment and optional additive particles, which flocculent mixture on heating at a temperature below the Tg of the latex resin, results in the formation of electrostatically bound aggregates ranging in size from about 2 microns to about 10 microns in volume average diameter as measured by the Coulter Counter. On subsequent heating for a few hours at about 10° C. to about 50° C. above the Tg of the resin in the presence of additional anionic surfactant, the aggregates are converted into integral toner particles. The aforementioned toners are especially useful for the development of colored images with excellent image resolution, color fidelity, and image projection efficiency.

PRIOR ART

Post office consumer paper is not generally recycled back to office-grade paper primarily because of contamination with reprographic paper waste. Recycling of reprographically produced imaged paper is inefficient because of the difficulty in separating toner agglomerates from pulp during the recycling process. Many deinking plants utilize known common steps in the recycling process, which process is comprised of shredding the paper into an aqueous surfactant media, and adjusting the pH to from about 8 to about 11 with alkali hydroxide or carbonates, resulting in the disintegration of paper into pulp fiber and toner agglomerates, followed by washing or separation of the toner agglomerates by floatation devices, and followed by collection of the pulp. Reprographic images do not usually disintegrate well when the wastepaper is repulped in the recycling steps, primarily since the toner resin is chemically resistant to an aqueous environment. Other inks, such as offset and flexographic inks contain no dominant thermoplastic binders but rely on oil-vehicles or other nondrying carriers. Flexo inks are designed to be water-soluble and disintegrate to particles of less than 10 microns in diameter. Conversely, reprographic images are well-fused with plastic binder, and disintegrate to specks which average 100 microns in diameter and only about 10 microns (the image pile height) in thickness. Removing these large specks from the repulped paper fiber is a clumsy and inefficient process primarily since there are no separatory steps which operate with high efficiency in this size region. Washing dirt from pulp works well only for specks less than about 20 microns; above that size the pulp fiber mat acts as a filter, trapping the larger particles. Froth flotation, a popular method in modern deinking technology, works well for particles with a size of about 25 to about 50 microns in diameter. Above that size, efficiency falls off, and the process is usually repeated many times, up to 10 times, to generate clean pulp from waste imaged paper. Centrifugal cleaners, also popular in deinking mills, do not become efficient until particles are 200 microns or more in diameter, and more spherical and denser than standard toner specks. Screens are used to remove even larger particles, and they are even less effective on toner specks.

In another embodiment thereof, the present invention is directed to an economical chemical process comprised of first solubilizing an imide based resin, such as poly(5-2(2,5-dioximide-tetrahydro)3-methyl-3-cyclohexene-1,2-dicarboxylimide-N-propyleneoxypropylene), in water containing a nonionic surfactant, such as sodium dodecylbenzene sulfonate, for example NEOGEN R® or NEOGEN SC®, and a nonionic surfactant, such as alkyl phenoxy poly(ethyleneoxy)ethanol, for example IGEPAL 897™ or ANTAROX 897™, and utilizing a base, such as potassium hydroxide, to adjust the pH of from about 10 to about 11, followed by precipitating said resin as a latex by adjusting the pH to acidic conditions using an acid, such as hydrochloric acid, during blending by high shear mixing, followed by adding an aqueous pigment dispersion containing a pigment, such as HELIOGEN BLUE™ or HOSTAPERM PINK™, and a cationic surfactant, such as benzalkonium chloride (SANIZOL B-50™). The mixing of the two dispersions with two oppositely charged surfactants induces flocculation of the imide resin latex, pigment and optional additive particles, which flocculent mixture on heating at a temperature below the Tg of the latex resin, results in the formation of electrostatically bound aggregates ranging in size from about 2 microns to about 10 microns in volume average diameter as measured by the Coulter Counter. On subsequent heating for a few hours at about 10° C. to 50° C. above the Tg of the resin in the presence of additional anionic surfactant, the aggregates are converted into integral toner particles. The aforementioned toners are especially useful for the development of colored images with excellent image resolution, color fidelity, and image projection efficiency.

In U.S. Pat. No. 5,366,841, the disclosure of which is totally incorporated herein by reference, there are illustrated emulsion/aggregation processes, and more specifically, a process for the preparation of toner compositions comprising:

(i) preparing a pigment dispersion in water, which dispersion is comprised of a pigment, an ionic surfactant and optionally a charge control agent;

(ii) shearing the pigment dispersion with a latex blend comprised of resin particles, an ionic surfactant of opposite charge polarity to that of said ionic surfactant in the pigment dispersion and a nonionic surfactant thereby causing a flocculation of resin, pigment, and charge control additive particles to form a uniform dispersion of solids in the water, and surfactant;

(iii) heating the above sheared blend at a temperature region about equal to or above the glass transition temperature (Tg) of the resin, while continuously stirring to form electrostatically bounded toner size aggregates with a narrow particle size distribution and wherein the temperature is from about 0° C. to about 10° C. above the resin Tg, and wherein the resin Tg is from about 30° C. to about 65° C. and preferably in the range of from about 45° C. to about 65° C.;

(iv) heating the statically bound aggregated particles from. about 10° C. to about 45° C. above the Tg of the resin particles to provide a toner composition comprised of polymeric resin, pigment and optionally a charge control agent; and (v) optionally separating and drying the toner.

Emulsion/aggregation toner processes are illustrated, for example, in U.S. Pat. Nos. 5,370,963; 5,344,738; 5,403,693; 5,418,108; 5,364,729 and 5,405,728.

SUMMARY OF THE INVENTION

Examples of objects of the present invention in embodiments thereof include:

It is an object of the present invention to provide toner compositions and processes with many of the advantages illustrated herein.

Another important object of the present invention resides in the provision of toners containing imide based resins, and which toners provide high image gloss, and excellent image fix at low fusing temperatures, and which toners are deinkable.

In another object of the present invention there are provided simple and economical processes for the direct preparation of black and colored toner compositions with, for example, excellent pigment dispersion to enable high image color fidelity and excellent image projection efficiency.

In another object of the present invention there are provided simple and economical chemical processes for black and colored toner compositions comprised of aggregation in which latex, pigment and additive particles aggregate to form electrostatically bound toner sized aggregates, followed by coalescence in which the latex particles within the aggregates coalesce and fuse together to afford integral toner particles of the present invention.

In a further object of the present invention there is provided a process for the preparation of toner particles with a volume average diameter of from between about 2 to about 10 microns, and with a narrow GSD of from about 1.10 to about 1.35 without the need for particle size classification.

In a further object of the present invention there is provided a chemical process for the preparation of toner compositions by aggregation and coalescence of latex, pigment and optional additive particles, with the resultant toner particle size being precisely achieved through proper control of the temperature at which aggregation is accomplished, and which temperature is generally in the range of from about 25° C. to about 65° C.

In yet another object of the present invention there are provided toner compositions with low fusing temperatures of about 5° C. to about 30° C. lower than those of conventional styrene-based toners.

In another object of the present invention there are provided toner compositions which provide high image projection efficiency of, for example, from over 65 to over 95 percent as measured by the Match Scan II spectrophotometer available from Milton-Roy.

In a further object of the present invention there are provided toner compositions, which when effectively fused on paper substrate, afford minimal or no paper curl.

These and other objects of the present invention are accomplished in embodiments by the provision of toners and processes thereof; and more specifically emulsion/aggregation/coalescence processes for the preparation of toner from imide based resins.

Embodiments of the present invention are as illustrated herein and include a toner comprised of pigment and an imide based resin, and wherein said resin is obtained by the condensation process as illustrated in U.S. Pat. Nos. 5,348,830; 5,409,793; 5,411,829; 5,411,831; 5,413,888; 5,427,882; 5,413,889; 5,427,881; 5,512,401, and 5,552,254, the disclosures of each of these patents being totally incorporated herein by reference. In an embodiment of the present invention, an imide based resin, such as poly(5-2(2,5-dioximidetetrahydro)-3-methyl-3-cyclohexene-1,2-dicarboxylimide-N-propyleneoxy propylene), and which imide based resin possesses a weight average molecular weight ($M_w$) of from about 20,000 to about 40,000, and a number average molecular weight ($M_n$) of from about 6,000 to about 15,000, relative to styrene standards, is formulated into a latex, aggregated and coalesced with pigment particles, and optionally other additives to toner. More specifically, the process comprises:

(i) solubilizing an imide based resin in caustic aqueous conditions, such as a pH of from about 10 to about 13, and preferably from about 10 to about 11, and in the presence of nonionic and anionic surfactants, followed by precipitating the dissolved imide resin into colloidal particles of from, for example, about 20 nanometers to about 500 nanometers, by acidifying the mixture to a pH of from, for example, about 2 to about 4 with a known acid, such as hydrochloric acid, and utilizing a high shearing device operating, for example, at from about 500 to about 2,000, or 1,000 to 1,500 revolutions per minute;

(ii) preparing, or providing a pigment dispersion in water, which dispersion is comprised of a pigment, an ionic surfactant and an optionally charge control agent;

(iii) shearing the imide based resin and an ionic surfactant having an opposite charge polarity to that of the ionic surfactant in the pigment dispersion, thereby causing a flocculation of the resin, pigment, surfactants, and optional charge control agent;

(iv) heating the resulting flocculent mixture with stirring at a temperature of from about 25° C. to about 1° C. about equal to, or about below the glass transition temperature (Tg) of the imide resin to effect formation of electrostatically bounded toner sized aggregates with a narrow aggregate size distribution, and wherein the resin has a Tg of from about 45° C. to about 65° C.;

(v) heating the resulting aggregate suspension in the presence of additional anionic surfactant selected in an amount of from about 0.01 to about 5 weight percent of the total reaction mixture, and which heating is at a temperature of from about 10° C. to about 55° C. above the Tg of the resin to form integral toner particles comprised of a polymeric resin, pigment and optionally a charge control agent; cooling, for example, to about from 25° to about 40° C.;

(vi) separating the toner by washing, especially washing with water, and drying the toner.

In embodiments, the present invention is directed to processes for the preparation of toner compositions which comprise initially preparing an ionic pigment dispersion, for example, by homogenizing an aqueous mixture of a pigment or pigments, such as carbon black like REGAL 330®, phthalocyanine, quinacridone or RHODAMINE B™ type, and optional additive particles with a cationic surfactant, such as benzalkonium chloride by means of a high shearing device, such as a Brinkman Polytron, thereafter blending this mixture using a high shear device, such as a polytron, a sonicator or microfluidizer, with a latex emulsion comprised of imide based resin particles stabilized with an anionic surfactant, such as sodium dodecylbenzene sulfonate, and nonionic surfactants, and wherein the latex size ranges, for example, from about 0.01 to about 1.0 micron, thereby enabling the flocculation of latex, pigment and optional additive particles; heating the mixture at a temperature of preferably from about 25° C. to about 1° C. below the Tg of the latex imide resin with mechanical stirring to effect formation of electrostatically bound aggregates with an average aggregate size ranging from about 1 to about 20 microns, and preferably from about 2 to 10 microns; followed by the addition of extra anionic surfactant, and heating of the resultant mixture at a temperature of preferably from about 10° C. to about 50° C. (Centigrade) above the Tg of the latex resin to effect coalescence of the latex particles within the aggregates to form integral toner particles; and subsequently, washing the toner product with, for example, water; and drying by means of, for example, a freeze dryer, a fluidized bed dryer, or a spray dryer to afford toner compositions comprised of an imide based pigment and optional additives with a toner size of preferably from 2 to 10 microns in volume average diameter.

Disclosed is a process for the preparation of toner comprising (i) solubilizing an imide based resin in water at pH of from about 10 to about 13, and which pH is obtained with a base, and which solubilizing is effected in the presence of nonionic and anionic surfactants, followed by precipitating the dissolved imide resin into colloidal particles of from about 20 nanometers to about 500 nanometers by applying a high shearing device operating at a speed of from about 500 to about 2,000 revolutions per minute and acidifying the mixture to a pH of from about 2 to about 4 with an acid;

(ii) preparing, or providing a pigment dispersion in water, which dispersion is comprised of a pigment, an oppositely charged cationic surfactant and optionally charge control agent;

(iii) shearing (i) and (ii), thereby causing a flocculation of the resin, pigment, surfactants, and optional charge control agent;

(iv) heating the resulting flocculent mixture with stirring at a temperature of from about 25° C. to about 1° C.

below the glass transition temperature (Tg) of the imide resin to effect formation of electrostatically bounded toner sized aggregates, or aggregates with a narrow aggregate size distribution, and wherein the resin has a Tg of from about 45° C. to about 65° C.;

(v) heating the resulting aggregate suspension in the presence of additional anionic surfactant selected in an amount of from about 0.01 to about 5 weight percent of the total reaction mixture solids, and which heating is at a temperature from about 10° C. to about 55° C. above the Tg of the resin to form integral toner particles comprised of a polymeric resin, pigment and optionally a charge control agent; and (vi) separating the toner by washing, and drying the toner; a process wherein the aggregate size, and the final toner particle size is from about 1 to about 20 microns in volume average diameter; a process wherein narrow GSD is from about 1.15 to about 1.25; wherein the ionic surfactant utilized in preparing the pigment dispersion is a cationic surfactant, and the ionic surfactant present in the latex emulsion is anionic; wherein the dispersion (i) is accomplished by homogenizing at from about 1,000 revolution per minute to about 10,000 revolutions per minute by microfluidization in a microfluidizer or in nanojet, or by an ultrasonic probe at from about 300 watts to about 900 watts of energy at a temperature of from about 25° C. to about 35° C. for a duration of from about 1 minute to about 120 minutes; wherein the heating of the flocculent mixture of latex, pigment, surfactants and optional charge control agent in (iii) is accomplished at temperatures of from about 2° C. to about 10° C. below the resin Tg for a duration of from about 30 minutes to about 6 hours; wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly (ethyleneoxy)ethanol; and wherein the anionic surfactant is selected from the group consisting of sodium dodecyl sulfate, sodium dodecylbenzene sulfate, and sodium dodecylnaphthalene sulfate; wherein the colloidal particles are from about 0.01 to 1 micron in volume average diameter; wherein the pigment particles are from about 0.01 to about 1 micron in volume average diameter; wherein the imide based resin is a polyimide, a polyesterimide, a polyimide-imine, a polyimide amide, a polyamic acid, or a polyimide amic acid; wherein the imide based resin has a weight average molecular weight of from about 10,000 to about 100,000 grams per mole, a number average molecular weight of from about 6,000 to about 30,000 grams per mole, and polydispersity of from about 2 to about 14; wherein the base is an alkali metal hydroxide, such as sodium hydroxide, potassium hydroxide, lithium hydroxide, beryllium hydroxide, magnesium hydroxide, calcium hydroxide, or barium hydroxide; an alkali metal carbonate, such as sodium bicarbonate, lithium bicarbonate, potassium bicarbonate, lithium carbonate, potassium carbonate, sodium carbonate, beryllium carbonate, magnesium carbonate, calcium carbonate, or barium carbonate; wherein the acid is hydrochloric acid, hydrobromic acid, hydroiodic acid, hydrofluoric acid, sulfuric acid, or phosphoric acid; a process for the preparation of toner compositions comprising (i) solubilizing an imide based resin in water at pH of from about 10 to about 13 with a base in the presence of a nonionic and anionic surfactants, followed by precipitating the dissolved imide resin into colloidal particles by applying a high shearing and acidifying the mixture to a pH of from about 2 to about 4, or from about 2 to about 3 with an acid;

(ii) preparing a pigment dispersion in water, which dispersion is comprised of a pigment, a cationic surfactant and an optionally charge control agent;

(iii) shearing the imide based and ionic surfactant having an opposite charge polarity to that of the ionic surfactant in the pigment dispersion, thereby causing a flocculation of the resin, pigment, surfactants, and optional charge control agent;

(iv) heating the resulting flocculent mixture with stirring at a temperature of from about 25° C. to about 1° C. below the glass transition temperature (Tg) of the resin to effect formation of toner sized aggregates;

(v) heating the resulting aggregate suspension in the presence of additional anionic surfactant selected in an amount of from about 0.01 to about 5 weight percent of total reaction mixture, and which heating is at a temperature from about 10° C. to about 55° C. above the Tg of the resin to form toner comprised of an imide polymeric resin, pigment and optionally a charge control agent; cooling to a suitable temperature, for example room temperature;

(vi) separating the toner by washing, and drying the toner; a process for the preparation of toner comprising shearing an imide based emulsion and a pigment dispersion, thereby causing a flocculation of the resin, pigment, and surfactants, wherein the imide is prepared by solubilizing an imide based resin in water at pH of from about 10 to about 13, and which pH is achieved with a base, and in the presence of a nonionic and anionic surfactants, followed by precipitating the dissolved imide resin into colloidal particles by acidifying the mixture to a pH of from, for example, about 2 to about 4 with an acid, and applying a high shearing device; and wherein the pigment dispersion is generated in water and which dispersion is comprised of a pigment, an ionic surfactant and an optional charge control agent; heating the resulting flocculent mixture with stirring at a temperature of from about 25° C. to about 1° C. below the glass transition temperature (Tg) of the imide resin to enable formation of toner sized aggregates, and wherein the resin has a Tg of from about 45° C. to about 65° C.;

heating the resulting aggregate suspension in the presence of additional anionic surfactant selected in an amount of from about 0.01 to about 5 weight percent of total reaction mixture, and which heating is at a temperature of from about 10° C. to about 55° C. above the Tg of the resin to form integral toner particles comprised of a polymeric resin, pigment; cooling;

separating the toner by washing with water, and drying the toner; a process wherein the nonionic surfactant is selected in an amount of from about 1 percent to about 5 percent by weight of toner; a process wherein the imide based resin is selected in an effective amount of from about 80 percent to about 96 percent by weight of toner; a process wherein the base is utilized in an amount of from about 1 percent to about 20 percent by weight of toner; and a process wherein the acid is utilized in an amount of from about 1 percent to about 5 percent by weight of toner.

Various known colorants or pigments present in the toner in an effective amount of, for example, from about 1 to about 20 percent by weight of the toner, and preferably in an amount of from about 3 to about 15 weight percent, that can be selected include carbon black like REGAL 330®, REGAL 660®, REGAL 400®, REGAL 400 R®, REGAL 330R®, REGAL 660R® and other equivalent black pigments. As colored pigments, there can be selected known cyan, magenta, red, green, blue, brown, yellow, or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAperm YELLOW FGL™, HOSTAPERM PINK E™ from Hoechst, and CINQUASIA MAGENTA™ available from E. I. DuPont de Nemours & Company, and the like. Generally, colored pigments that can be selected are cyan, magenta, or yellow pigments. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL.

The toner may also include known charge additives in effective amounts of, for example, from 0.1 to 5 weight percent, such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference; nitrobenzene sulfonates; TRH a known charge enhancing additive aluminum complex, BONTRON E-84™ and E-88™, available from Orient Chemicals, and other known charge enhancing additives, and the like. Mixtures of charge additives may also be selected.

Examples of anionic surfactants selected for the emulsion polymerization and for preparation of the latex resin for the toner compositions of the present invention include, for example, sodium dodecylsulfate, sodium dodecylbenzene sulfonate, sodium dodecylnaphthalene sulfate, dialkyl benzenealkyl, sulfates and sulfonates, abetic acid, available from Aldrich, NEOGEN R™, NEOGEN SC™ obtained from Kao and the like. One effective concentration of the anionic surfactant is, for example, from about 0.01 to about 10 percent by weight, and preferably from about 0.1 to about 5 percent by weight of the latex resin.

Illustrative examples of nonionic surfactants selected in amounts of, for example, from about 0.01 to about 10 percent by weight, and preferably from about 0.1 to about 5 percent by weight of latex resin in embodiments, include dialkylphenoxypoly(ethyleneoxy) ethanol available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™.

Examples of cationic surfactants utilized in the pigment dispersion for the toners and processes of the present invention include, for example, dialkyl benzenealkyl ammonium chloride, lauryl trimethyl ammonium chloride, alkyl benzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, and mixtures thereof. This surfactant is utilized in various effective amounts, such as for example from about 0.01 to about 10 percent by weight of latex resin. Generally, the molar ratio of the cationic surfactant in the pigment dispersion to the anionic surfactant utilized in the latex preparation is in the range of from about 0.05 to about 4, and preferably from 0.05 to 2.

Examples of the additional surfactants, which are added prior to coalescence to prevent further growth in aggregate size with temperature, include anionic surfactants, such as sodium dodecylbenzene sulfonate, sodium dodecylnaphthalene sulfate, dialkyl benzenealkyl, sulfates and sulfonates, abitic acid available from Aldrich, NEOGEN R™, NEOGEN SC™ obtained from Kao and the like, and nonionic surfactants, such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. One effective concentration of this added surfactant that primarily functions to stabilize the aggregate size during coalescence ranges, for example, from about 0.01 to about 10 percent by weight, and preferably from about 0.05 to about 5 percent by weight of the total weight of reaction mixture solids.

Surface additives that can be added to the toner compositions after, for example, washing and drying include, for example, those mentioned herein, such as metal salts, metal salts of fatty acids, metal oxides, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from 0.1 to 2 percent, which can also be added during aggregation or coalescence, washing or drying, and wherein the additives are mechanically coated onto the surface of the toner product.

Examples of imide based resins are polyimide, polyester imide, polyimide-imine, polyamic acid, polyimide amide, mixture thereof and the like. The imide based resin is present in an effective amount of, for example, from about 80 to about 96 percent by weight of the toner.

Examples of bases that are utilized in solubilizing the imide based resin in water include sodium hydroxide, potassium hydroxide, magnesium hydroxide, barium hydroxide, sodium bicarbonate, sodium carbonate, potassium bicarbonate, potassium carbonate, magnesium carbonate, mixture thereof and the like. The base utilized in adjusting the pH of the mixture, of from a pH of about 10 to about 13, is selected in an effective amount of, for example, from about 0.01 percent to about to about 5 percent by weight of the imide based resin.

Examples of acids utilized in adjusting the pH to acidic conditions include hydrochloric acid, hydrobromic acid, hydrofluoric acid, hydroiodic acid, sulfuric acid, phosphoric acid, mixture thereof and the like. The acid utilized in adjusting the pH to from about a pH of 2 to about 13 is utilized in an effective amount of, for example, from about 0.01 percent to about to about 5 percent by weight of the imide based resin.

Developer compositions can be prepared by blending the toners obtained with the processes of the present invention with known carrier particles, including coated carriers, such as steel, iron, ferrites, and the like, reference U.S. Pat. Nos. 4,937,166 and 4,935,326, the disclosures of which are totally incorporated herein by reference, for example from about 2 percent toner concentration to about 8 percent toner concentration. The present invention differs in that, for example, there are provided toners based on, for example, certain imide based resins, and wherein the weight average molecular weight ($M_w$) of the latex resin relative to the styrene standard is from about 10,000 to about 80,000, and the number average molecular weight ($M_n$) of the latex is from about 6,000 to about 30,000. Advantages achievable with the toners of the present invention include paper recyclability, lower toner fusing temperature, enhanced image resolution from narrow toner particle size distribution, low or no background noise as a result of improved toner triboelectric charge distribution, a lesser amount of out-of-specification fine particles, and the provision of high image quality.

The invention process in embodiments thereof possesses a number of advantages as indicated herein including the effective preparation of small toner particles with narrow particle size distribution without the need to utilize conventional pulverization and classification processes; the process is highly energy efficient as it is primarily a wet process and usually does not involve energy intensive grinding or pulverization and classification processes; and high toner yields, shorter process times and shorter change over time for preparing different color toners, therefore, rendering the process attractive and economical. The process of the present invention is particularly efficient for generating a toner particle size of below 10 microns, or more specifically, below about 8 microns, which is in the regime where conventional pulverization/classification methods can be very cost ineffective. Furthermore, the toners of the present invention are environmental friendly, in that Post Office consumer paper can be recycled into office-grade paper primarily because of the ease in the removal of toner contaminations in caustic environments.

The following Examples are being submitted to further define the various aspects of the present invention. These Examples are intended to be illustrative only and are not intended to limit the scope of the present invention.

EXAMPLE I

25 Grams of poly(5-2(2,5-dioximide-tetrahydro)3-methyl-3-cyclohexene-1,2-dicarboxylimide-N-propyleneoxy-propylene), obtained as illustrated in Example I of U.S. Pat. No. 5,411,829, were added to 100 grams of water containing 1.5 percent by weight of the anionic surfactant (NEOGEN R™), and 1.5 percent by weight of the nonionic surfactant (ANTAROX™). To this mixture was then added dropwise a 10 percent solution of potassium hydroxide until the pH of the mixture was retained at from about 10 to about 11 during which time the resin solubilized. The resulting mixture was then sheared using a polytron IKA-tron DZM-f (available from IKA Laboratechnik) at 1,000 revolutions per minutes, and during which a solution of 10 percent by weight of hydrochloric acid was added until the pH of the mixture was maintained at about 3 to about 3.5. To the resulting imide based latex emulsion were then added 100 grams of an aqueous pigment dispersion containing 2.5 grams of dispersed BHD 6000 Sunsperse Cyan Pigment (54.4 weight percent of pigment) obtained from Sun Chemicals, and 1.3 grams of cationic surfactant, SAN IZOL B™, were simultaneously added to 400 grams of water with high stirring using a polytron. Subsequently, the mixture was transferred to a 1 liter reaction vessel and heated at a temperature of 40° C. for 3 hours to enable formation of 4.5 micron aggregates with a GSD of 1.21. After the addition of 10 milliliters of a 20 percent an ionic surfactant (NEOGEN R™) solution, the aggregate suspension was heated to a temperature of 93° C. (Centigrade throughout) and retained at this temperature there for a period of 4 hours. The resulting toner product evidenced a particle size of 4.6 microns with a GSD of 1.24 as measured with a Coulter Counter.

Standard fusing properties of the toner compositions were evaluated as follows: unfused images of toner on paper with a controlled toner mass per unit area of 1.2 milligrams/cm$^2$ were produced by one of a number of methods. A suitable electrophotographic developer was produced by mixing from 2 to 10 percent by weight of the toner with a suitable electrophotographic carrier of a 90 micron diameter ferrite core, spray coated with 0.5 weight percent of a terpolymer of poly(methyl methacrylate), styrene, and vinyltriethoxysilane, and roll milling the mixture for 10 to 30 minutes to produce a tribocharge of between −5 to −20 microcoulombs per gram of toner as measured with a Faraday Cage. The developer was then introduced into the small electrophotographic copier Mita DC-111 in which the fuser system had been disconnected. Between 20 and 50 unfused images of a test pattern consisting of a 65 millimeter by 65 millimeter square solid area were produced on 8½ by 11 inch sheets of a typical electrophotographic paper such as Xerox Image LX© paper.

The unfused images were then fused by feeding them through a hot roll fuser system consisting of a fuser roll and pressure roll with VITON surfaces, both of which were heated to a controlled temperature. Fused images were produced over a range of hot roll fusing temperatures of from about 130° C. to about 210° C.

The toner as prepared in Example I had a gloss T($G_{50}$) of 142° C. and an MFT of 130° C. The gloss of the fused images was measured according to TAPPI Standard T480 at a 75° angle of incidence and reflection using a NOVO-GLOSS© Statistical Glossmeter, Model GL-NG1002S from Paul N. Gardner Company, Inc. The degree of permanence of the fused images was evaluated by the Crease Test. The fused image was folded under a specific weight with the toner image to the inside of the fold. The image was then unfolded and any loose toner wiped from the resulting Crease with a cotton swab. The average width of the paper substrate which shows through the fused toner image in the vicinity of the Crease was measured with a custom built image analysis system.

EXAMPLE II

A toner was prepared from the above Example I latex emulsion in accordance with the procedure of Example I except that the aggregation reaction was conducted at 48° C. for 1.5 hours to provide 6.2 micron (volume average diameter) aggregates with a GSD of 1.24. Subsequently, the coalescence was performed at 93° C. for a period of 4 hours. The resulting toner product showed a particle size of 6.5 microns with a GSD of 1.25. Fusing evaluation indicated that the toner of this Example had a $T(G_{50})$ of 140° C. and an MFT of 135° C.

Other embodiments and modifications of the present invention may occur to those skilled in the art subsequent to a review of the information presented herein; these embodiments and modifications, as well as equivalents thereof, are also included within the scope of the present invention.

What is claimed is:

1. A process for the preparation of toner comprising (i) solubilizing an imide based resin in water at pH of from about 10 to about 13 and which solubilizing is accomplished in the presence of nonionic surfactants and anionic surfactants; followed by precipitating the resulting dissolved imide resin into colloidal particles with a size diameter of from about 20 nanometers to about 500 nanometers, and which precipitating is accomplished with a high shearing device operating at a speed of from about 500 to about 2,000 revolutions per minute; acidifying the resulting mixture to a pH of from about 2 to about 4;

(ii) preparing a pigment dispersion in water, which dispersion is comprised of a pigment, an oppositely charged ionic surfactant and optionally charge control agent;

(iii) shearing (i) and (ii), thereby causing a flocculation of the resin, pigment, surfactants, and optional charge control agent;

(iv) heating the resulting flocculent mixture of (iii) with stirring at a temperature of from about 25° C. to about 1° C. below the glass transition temperature (Tg) of the imide resin to effect formation of electrostatically bounded toner sized aggregates, and wherein the imide resin has a Tg of from about 45° C. to about 65° C.;

(v) heating the resulting said toner aggregates of (iv) in the presence of additional anionic surfactant selected in an amount of from about 0.01 to about 5 weight percent based on the weight percent of the total reaction mixture solids, and which heating is at a temperature of from about 10° C. to about 55° C. above the Tg of the imide resin to form toner; and optionally cooling, and optionally (vi) separating said toner by washing, and thereafter drying said toner.

2. A process in accordance with claim 1 wherein the aggregate size, and the final toner particle size is from about 1 to about 20 microns in volume average diameter, which heating at a temperature of from about 10° C. to about 55° C. above the Tg of the imide resin forms integral toner particles comprised of a polymeric resin, pigment and optionally a charge control agent; and wherein cooling, separating, washing and drying is accomplished.

3. A process in accordance with claim 1 wherein in (iv) there is formed said toner aggregates with a narrow size distribution, or GSD of from about 1.15 to about 1.25.

4. A process in accordance with claim 1 wherein the ionic surfactant utilized in preparing the pigment dispersion is a cationic surfactant, and the ionic surfactant present in (i), or in the latex emulsion is anionic.

5. A process in accordance with claim 1 wherein the dispersion (i) is accomplished by homogenizing at from about 1,000 revolutions per minute to about 10,000 revolutions per minute by microfluidization in a microfluidizer or in nanojet, or by an ultrasonic probe at from about 300 watts to about 900 watts of energy at a temperature of from about 25° C. to about 35° C. for a duration of from about 1 minute to about 120 minutes.

6. A process in accordance with claim 1 wherein the heating of the flocculent mixture of latex, pigment, surfactants and optional charge control agent in (iii) is accomplished at temperatures of from about 2° C. to about 10° C. below the resin Tg for a duration of from about 30 minutes to about 6 hours.

7. A process in accordance with claim 1 wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol; and wherein the anionic surfactant is selected from the group consisting of sodium dodecyl sulfate, sodium dodecylbenzene sulfate, and sodium dodecylnaphthalene sulfate.

8. A process in accordance with claim 1 wherein the colloidal particles are from about 0.01 to 1 micron in volume average diameter.

9. A process in accordance with claim 1 wherein the pigment particles are from about 0.01 to about 1 micron in volume average diameter.

10. A process in accordance with claim 1 wherein the imide based resin is a polyimide, a polyesterimide, a polyimide-imine, a polyimide amide, a polyamic acid, or a polyimide amic acid.

11. A process in accordance with claim 1 wherein the imide based resin has a weight average molecular weight of from about 10,000 to about 100,000 grams per mole, a number average molecular weight of from about 6,000 to about 30,000 grams per mole, and polydispersity of from about 2 to about 14.

12. A process in accordance with claim 1 wherein there is selected a base for achieving a pH of from about 11 to about 13, and which base is sodium hydroxide, potassium hydroxide, lithium hydroxide, beryllium hydroxide, magnesium hydroxide, calcium hydroxide, barium hydroxide, sodium bicarbonate, lithium bicarbonate, potassium bicarbonate, lithium carbonate, potassium carbonate, sodium carbonate, beryllium carbonate, magnesium carbonate, calcium carbonate, or barium carbonate.

13. A process in accordance with claim 1 wherein there is selected an acid to achieve a pH of from about 2 to about 4, and wherein the acid is hydrochloric acid, hydrobromic acid, hydroiodic acid, hydrofluoric acid, sulfuric acid, or phosphoric acid.

14. A process for the preparation of toner comprising (i) solubilizing an imide based resin in water, and achieving with a base at a pH of from about 10 to about 13, and which solubilizing is accomplished in the presence of a nonionic surfactant and an anionic surfactant, followed by precipitating the dissolved imide resin into colloidal particles, and acidifying the mixture to a pH of from about 2 to about 4 with an acid;

(ii) preparing or providing a pigment dispersion in water, which dispersion is comprised of a pigment and a ionic surfactant;

(iii) shearing the resulting imide based resin and ionic surfactant having an opposite charge polarity to that of said ionic surfactant in the pigment dispersion, thereby causing a flocculation of the resin, pigment, surfactants, and optional charge control agent;

(iv) heating the resulting flocculent mixture with stirring at a temperature of from about 25° C. to about 1° C. below the glass transition temperature (Tg) of the resin to effect formation of toner sized aggregates, and wherein the resin has a Tg of from about 45° C. to about 65° C.;

(v) heating the resulting said toner aggregates in the presence of additional anionic surfactant, and which heating is at a temperature of from about 10° C. to about 55° C. above the Tg of the resin to form toner comprised of an imide polymeric resin, pigment and optionally a charge control agent; and optionally cooling and (vi) separating said toner by washing with water, and thereafter drying said toner.

15. A process for the preparation of toner comprising shearing an imide based emulsion and a pigment dispersion, thereby causing a flocculation of the resin, pigment, and surfactants, wherein said imide is prepared by solubilizing an imide based resin in water at pH of from about 10 to about 13, and which pH is achieved with a base, and in the presence of nonionic and anionic surfactants, followed by precipitating the dissolved imide resin into colloidal particles by acidifying the mixture, and shearing; and wherein the pigment dispersion is generated in water, and which dispersion is comprised of a pigment and an ionic surfactant; heating the resulting flocculent mixture at a temperature of from about 25° C. to about 1° C. below the glass transition temperature (Tg) of the imide resin to enable formation of aggregates; heating the resulting aggregate suspension in the presence of additional anionic surfactant, and which heating is at a temperature of from about 10° C. to about 55° C. above the Tg of the resin to form toner; cooling; and separating said toner by washing, and thereafter drying said toner.

16. A process in accordance with claim 1 wherein the nonionic surfactant is selected in an amount of from about 1 percent to about 5 percent by weight of toner.

17. A process in accordance with claim 1 wherein the imide based resin is selected in an effective amount of from about 80 percent to about 96 percent by weight of toner.

18. A process in accordance with claim 12 wherein the base is selected in an amount of from about 1 percent to about 20 percent by weight of toner.

19. A process in accordance with claim 13 wherein the acid is selected in an amount of from about 1 percent to about 5 percent by weight of toner.

20. A process in accordance with claim 15 wherein the acidifying is to a pH of from about 2 to about 4, and wherein shearing is with a high shearing device; heating the resulting flocculent mixture is accomplished with stirring at a temperature of from about 25° C. to about 1° C. below the glass transition temperature (Tg) of the imide resin to enable formation of toner sized aggregates, and wherein the resin has a Tg of from about 45° C. to about 65° C.;

heating the resulting said toner aggregates in the presence of additional anionic surfactant selected in an amount of from about 0.01 to about 5 weight percent of the total reaction mixture solids, and which heating is at a temperature from about 10° C. to about 55° C. above the Tg of the resin to form integral toner particles comprised of a polymeric resin, pigment, and charge control agent; cooling; and separating said toner by washing, and thereafter drying said toner.

21. A process for the preparation of toner comprising (i) solubilizing an imide based resin in water at pH of from about 10 to about 13, and which solubilizing is accomplished in the presence of nonionic surfactants and anionic surfactants, and wherein said pH is achieved with a base; followed by precipitating the resulting dissolved imide resin into colloidal particles; acidifying the resulting mixture to a pH of from about 2 to about 4;

(ii) mixing with (i) an aqueous pigment dispersion and an oppositely charged ionic surfactant;

(iii) shearing (i) and (ii);

(iv) heating the resulting flocculent mixture of (iii) with stirring at a temperature of from about 25° C. to about 1° C. below the glass transition temperature (Tg) of the imide resin to form aggregates;

(v) heating the resulting aggregates of (iv) in the presence of additional anionic surfactant and which heating is at a temperature of from about 10° C. to about 55° C. above the Tg of the imide resin to form toner; cooling, and (vi) separating said toner by washing, and thereafter drying said toner.

* * * * *